US007348938B2

(12) United States Patent
Kang et al.

(10) Patent No.: US 7,348,938 B2
(45) **Date of Patent: *Mar. 25, 2008**

(54) METHOD AND APPARATUS FOR DRIVING PLASMA DISPLAY PANEL

(75) Inventors: Seong Ho Kang, Daegu (KR); Sang Jin Yun, Pohang-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/488,824

(22) Filed: Jul. 19, 2006

(65) Prior Publication Data

US 2006/0256056 A1 Nov. 16, 2006

Related U.S. Application Data

(63) Continuation of application No. 10/659,707, filed on Sep. 11, 2003, now Pat. No. 7,102,596.

(30) Foreign Application Priority Data

Sep. 12, 2002 (KR) ..... 10-2002-55381
Sep. 12, 2002 (KR) ..... 10-2002-55382

(51) Int. Cl.
*G09G 3/28* (2006.01)

(52) U.S. Cl. ..... 345/60; 345/67; 345/68; 345/77

(58) Field of Classification Search ..... 345/60, 345/77, 67, 68; 315/169.3
See application file for complete search history.

(56) References Cited

U.S. PATENT DOCUMENTS 6,288,495 B1 9/2001 Yashiro ..... 315/169.1
2003/0001802 A1 1/2003 Ide et al. ..... 345/60

FOREIGN PATENT DOCUMENTS

| | | |
|---|---|---|
| EP | 0 191 511 | 11/1988 |
| EP | 0 755 043 A1 | 1/1997 |
| EP | 0 866 439 | 9/1998 |
| EP | 1 047 040 A1 | 10/2000 |
| EP | 1 136 975 | 9/2001 |
| EP | 1 271 464 A2 | 1/2003 |

(Continued)

OTHER PUBLICATIONS

European Search Report dated Oct. 16, 2006.

(Continued)

*Primary Examiner*—David H. Vu
(74) *Attorney, Agent, or Firm*—Ked & Associates, LLP

(57) ABSTRACT

A method and apparatus of driving a plasma display panel that is adaptive for making a stable operation at both a low temperature and a high temperature. In the apparatus, a scan driver applies a first sustaining pulse to a scan electrode during a sustain period. A sustain driver applies a second sustaining pulse alternating with the first sustaining pulse to a common sustain electrode during the sustain period. A sustain voltage source supplies a driving voltage to the scan driver and the sustain driver such that the first and second sustaining pulses can be applied. A controller controls a voltage value of the driving voltage in correspondence with a driving temperature at which the panel is driven.

8 Claims, 12 Drawing Sheets

FOREIGN PATENT DOCUMENTS

| | | |
|---|---|---|
| EP | 1 398 756 | 3/2004 |
| JP | 04-284492 | 10/1992 |
| JP | 09-097032 | 4/1997 |
| JP | 09-006283 | 10/1997 |
| JP | 10-207426 | 8/1998 |
| JP | 10-207427 | 8/1998 |
| JP | 2000-227780 | 8/2000 |
| JP | 2002-207449 | 7/2002 |
| KR | 1998-0010983 | 4/1998 |
| KR | 2000-0003326 | 1/2000 |
| WO | WO 99/30308 | 6/1999 |

OTHER PUBLICATIONS

European Search Report dated May 5, 2006.

METHOD AND APPARATUS FOR DRIVING PLASMA DISPLAY PANEL

CROSS-REFERENCE TO RELATED APPLICATIONS

This is a Continuation Application of prior application Ser. No. 10/659,707 filed Sep. 11, 2003 now U.S. Pat. No. 7,102,596 whose entire disclosure is incorporated herein by reference. Further, this application claims the benefit of the Korean Application Nos. P2002-55381 and P2002-55382 both filed on Sep. 12, 2002, which are hereby incorporated by reference.

BACKGROUND OF THE INVENTION

1. Field of the Invention

This invention relates to a technique for driving a plasma display panel, and more particularly to a method and apparatus of driving a plasma display panel that is adaptive for making a stable operation at both a low temperature and a high temperature.

2. Background of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a sustain electrode pair having a scan electrode 30Y and a common sustain electrode 30Z provided on an upper substrate 10, and an address electrode 20X provided on a lower substrate 18 in such a manner to perpendicularly cross the sustain electrode pair. Each of the scan electrode 30Y and the common sustain electrode 30Z has a structure disposed with transparent electrodes 12Y and 12Z and metal bus electrodes 13Y and 13Z thereon. On the upper substrate 10 provided, in parallel, with the scan electrode 30Y and the common sustain electrode 30Z, an upper dielectric layer 14 and an MgO protective film 16 are disposed. A lower dielectric layer 22 and barrier ribs 24 are formed on the lower substrate 18 provided with the address electrode 20X, and a phosphorous material layer 26 is coated onto the surfaces of the lower dielectric layer 22 and the barrier ribs 24. An inactive mixture gas such as He+Xe, Ne+Xe or He+Ne+Xe is injected into a discharge space provided among the upper substrate 10, the lower substrate 18 and the barrier ribs 24.

Such a PDP makes a time-divisional driving of one frame, which is divided into various sub-fields having a different emission frequency, so as to realize gray levels of a picture. Each sub-field is again divided into an initialization period for initializing the entire field, an address period for selecting a scan line and selecting the cell from the selected scan line and a sustain period for expressing gray levels depending on the discharge frequency. The initialization period is divided into a set-up interval supplied with a rising ramp waveform and a set-down interval supplied with a falling ramp waveform.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of 2n (wherein n=0, 1, 2, 3, 4, 5, 6 and 7) at each sub-field.

FIG. 3 shows a driving waveform of the PDP applied to two sub-fields. Herein, Y represents the scan electrode; Z does the common sustain electrode; and X does the address electrode.

Referring to FIG. 3, the PDP is divided into an initialization period for initializing the full field, an address period for selecting a cell, and a sustain period for sustaining a discharge of the selected cell for its driving.

In the initialization period, a rising ramp waveform Ramp-up is simultaneously applied all the scan electrodes Y in a set-up interval SU. A discharge is generated within the cells at the full field with the aid of the rising ramp waveform Ramp-up. By this set-up discharge, positive wall charges are accumulated onto the address electrode X and the sustain electrode Z while negative wall charges are accumulated onto the scan electrode Y.

In a set-down interval SD, a falling ramp waveform Ramp-down falling from a positive voltage lower than a peak voltage of the rising ramp waveform Ramp-up is simultaneously applied to the scan electrodes Y after the rising ramp waveform Ramp-up was applied. The falling ramp waveform Ramp-down causes a weak erasure discharge within the cells to erase a portion of excessively formed wall charges. Wall charges enough to generate a stable address discharge are uniformly left within the cells with the aid of the set-down discharge.

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the initialization period to thereby generate an address discharge within the cells supplied with the data pulse data. Wall charges enough to cause a discharge when a sustain voltage is applied are formed within the cells selected by the address discharge.

Meanwhile, a positive direct current voltage Zdc is applied to the common sustain electrodes Z during the set-down interval and the address period. The direct current voltage Zdc causes a set-down discharge between the common sustain electrode Z and the scan electrode Y, and establishes a voltage difference between the common sustain electrode Z and the scan electrode Y or between the common sustain electrode Z and the address electrode X so as not to make a strong discharge between the scan electrode Y and the common electrode Z in the address period.

In the sustain period, a sustaining pulse sus is alternately applied to the scan electrodes Y and the common sustain electrodes Z. Then, a wall voltage within the cell selected by the address discharge is added to the sustain pulse sus to thereby generate a sustain discharge, that is, a display discharge between the scan electrode Y and the common sustain electrode Z whenever the sustain pulse sus is applied.

Finally, after the sustain discharge was finished, a ramp waveform erase having a small pulse width and a low voltage level is applied to the common sustain electrode Z to thereby erase wall charges left within the cells of the entire field.

However, such a conventional PDP has a problem in that it causes an unstable driving at the high-temperature atmosphere or the low-temperature atmosphere. For instance, the PDP has a problem in that, when it is driven at a high-temperature (i.e., approximately more than 40° C.), it causes an unstable sustain discharge. In other words, when the PDP is driven at the high-temperature atmosphere, a sustain discharge is not generated at specific discharge cells. Such an unstable sustain discharge at the high-temperature atmosphere results from a motion of space charges being activated at the high-temperature atmosphere and hence wall charges being easily re-combined.

Meanwhile, the unstable sustain discharge phenomenon generated at the high-temperature atmosphere is more serious as a driving temperature of the panel rises more highly than the peripheral temperature. In other words, the panel of the conventional PDP is raised into a higher temperature than the peripheral temperature by a heat resulting from the sustain discharge.

In addition, when the PDP is driven at a low-temperature atmosphere (i.e., approximately 20° C. to −20° C.), a mis-writing phenomenon is caused in the address period. In other words, when the PDP is driven at the low-temperature atmosphere, there occurs a mis-writing phenomenon in which desired discharge cells are not selected. A major cause of the mis-writing phenomenon at the low temperature results from a motion of particles being dulled at the low temperature. In other words, a discharge delay is increased by a motion slow-down of particles at the low temperature, and thus sufficient wall charges are not formed at the discharge cell.

More specifically, the scanning pulse scan applied to the scan electrode Y in the address period of the PDP may be set to 1.3 μs as shown in FIG. 4. In this case, the data pulse data set to 1.3 μs is applied to the address electrode X in such a manner to be synchronized with the scanning pulse scan.

If the scanning pulse scan set to 1.3 μs is applied to the scan electrode Y at a temperature exceeding the low temperature and the data pulse data synchronized with the scanning pulse scan is applied to the address electrode X, then a stable address discharge is generated at the discharge cell. However, there is raised a problem in that an address discharge is not generated during an application time of the scanning pulse scan due to the discharge delay increased as shown in FIG. 4.

SUMMARY OF THE INVENTION

Accordingly, it is an object of the present invention to provide a method and apparatus of driving a plasma display panel that is adaptive for making a stable operation at both a low temperature and a high temperature.

In order to achieve these and other objects of the invention, a driving apparatus for a plasma display panel according to one aspect of the present invention includes a scan driver for applying a first sustaining pulse to a scan electrode during a sustain period; a sustain driver for applying a second sustaining pulse alternating with the first sustaining pulse to a common sustain electrode during the sustain period; a sustain voltage source for supplying a driving voltage to the scan driver and the sustain driver such that the first and second sustaining pulses can be applied; and control means for controlling a voltage value of the driving voltage in correspondence with a driving temperature at which the panel is driven.

In the driving apparatus, the sustain voltage source includes at least two driving voltage sources for supplying the driving voltage; and a plurality of switching devices provided among the driving voltage source, the scan driver and the sustain driver.

Herein, the control means includes a temperature sensor for generating a bit control signal corresponding to the driving temperature at which the panel is driven; and a switch controller for turning on any one of the switching devices in response to the bit control signal.

The temperature sensor divides a high temperature into a plurality of temperature levels, and generates the bit control signal differentiated for each temperature level.

The switch controller controls the switching devices such that the first and second sustaining pulses having a lower voltage value as a temperature of the panel is more raised can be applied in response to the bit control signal.

A driving apparatus for a plasma display panel according to another aspect of the present invention includes a scan driver for applying a scanning pulse and a first sustaining pulse to a scan electrode; a sustain driver for applying a second sustaining pulse alternating with the first sustaining pulse to a common sustain electrode; a temperature senor for sensing a peripheral temperature at which the panel is driven; and a sustain voltage source for supplying a driving voltage to the scan driver and the sustain driver such that the first and second sustaining pulses can be applied; and a timing controller for controlling the scan driver and the sustain driver in correspondence with the peripheral temperature sensed by the temperature sensor.

In the driving apparatus, the temperature sensor includes a first temperature sensor for sensing a high driving temperature; and a second temperature sensor for sensing a low driving temperature.

Herein, the high temperature is 40° C. to 90° C. while the low temperature is 20° C. to −20° C.

The timing controller controls the scan driver and the sustain driver such that first and second sustaining pulses each having a first period can be applied when the panel is driven at the high temperature, whereas it controls the scan driver and the sustain driver such that first and second sustaining pulses each having a second period different from the first period can be applied at the other case.

Herein, the first period is wider than the second period.

The first temperature sensor divides a high temperature into a plurality of temperature levels, and generates the bit control signal differentiated for each temperature level.

The timing controller controls the scan driver and the sustain driver such that the first and second sustaining pulses each having a wider period as the temperature level is more raised can be applied.

Herein, periods of the first and second sustaining pulses are set widely as a high interval and a low interval of the first and second sustaining pulses are widened equally.

Alternatively, periods of the first and second sustaining pulses are set widely as low intervals of the first and second sustaining pulse are kept constantly while high intervals of the first and second sustaining pulses are widened.

Otherwise, periods of the first and second sustaining pulses are set widely as high intervals of the first and second sustaining pulse are kept constantly while low intervals of the first and second sustaining pulses are widened.

The timing controller controls the scan driver such that the scanning pulse having a first width can be applied when the panel is driven at the low temperature while the scanning pulse having a second width different from the first width can be applied at the other case.

Herein, the first width is wider than the second width.

The second temperature sensor divides the low temperature into a plurality of temperature levels, and generates the bit control signal differentiated for each temperature level.

The timing controller controls the scan driver such that the scanning pulse having a larger width as the temperature level is more lowered can be applied.

Herein, a width of the scanning pulse is set to 1.1 μs to 5 μs.

The driving apparatus further includes a data driver for applying a data pulse corresponding to the width of the scanning pulse under control of the timing controller.

A method of driving a plasma display panel according to still another aspect of the present invention includes the steps of applying a sustaining pulse having a first period when the panel is driven at the normal temperature; and applying a sustaining pulse having a second period different from the first period when the panel is driven a temperature higher than the normal temperature.

In the method, the second period is wider than the first period.

The method further includes the steps of dividing the high temperature into a plurality of temperature levels; and setting the second period in correspondence with the temperature level.

Herein, the second period is more widened as the temperature level is more raised.

The method further includes the step of setting a voltage value of a sustaining pulse applied when the panel is driven at the normal temperature to be different from that of a sustaining pulse applied when the panel is driven at a temperature higher than the normal temperature.

Herein, the voltage value of the sustaining voltage applied when the panel is driven at the high temperature is set to be lower than that of the sustaining pulse applied when the panel is driven at the normal temperature.

The method further includes the steps of dividing the high temperature into a plurality of temperature levels; and setting the voltage value of the sustaining pulse in correspondence with the temperature level.

Herein, the voltage value of the sustaining pulse is more lowered as the temperature level is more raised.

A method of driving a plasma display panel according to still another aspect of the present invention includes the steps of applying a scanning pulse having a first width when the panel is driven at the normal temperature; and applying a scanning pulse having a second width different from the first width when the panel is driven a temperature lower than the normal temperature.

In the method, the second width is larger than the first width.

The method further includes the steps of dividing the low temperature into a plurality of temperature levels; and setting the second width of the scanning pulse in correspondence with the temperature level.

Herein, the second width is more enlarged as the temperature level is more lowered.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF PREFERRED EMBODIMENTS

Figure 1:
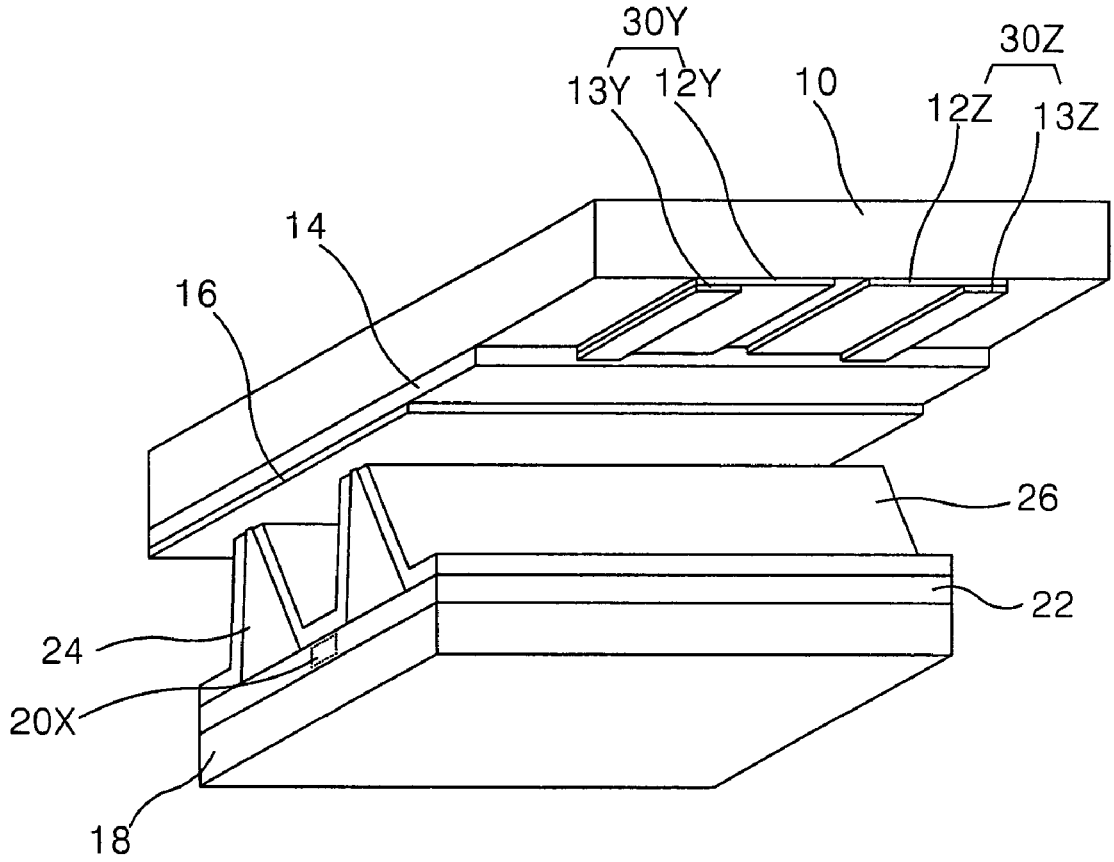
FIG. 1 RELATED ART
FIG. 1 is a perspective view showing a discharge cell structure of a conventional three-electrode, AC surface-discharge plasma display panel.
Figure 2:
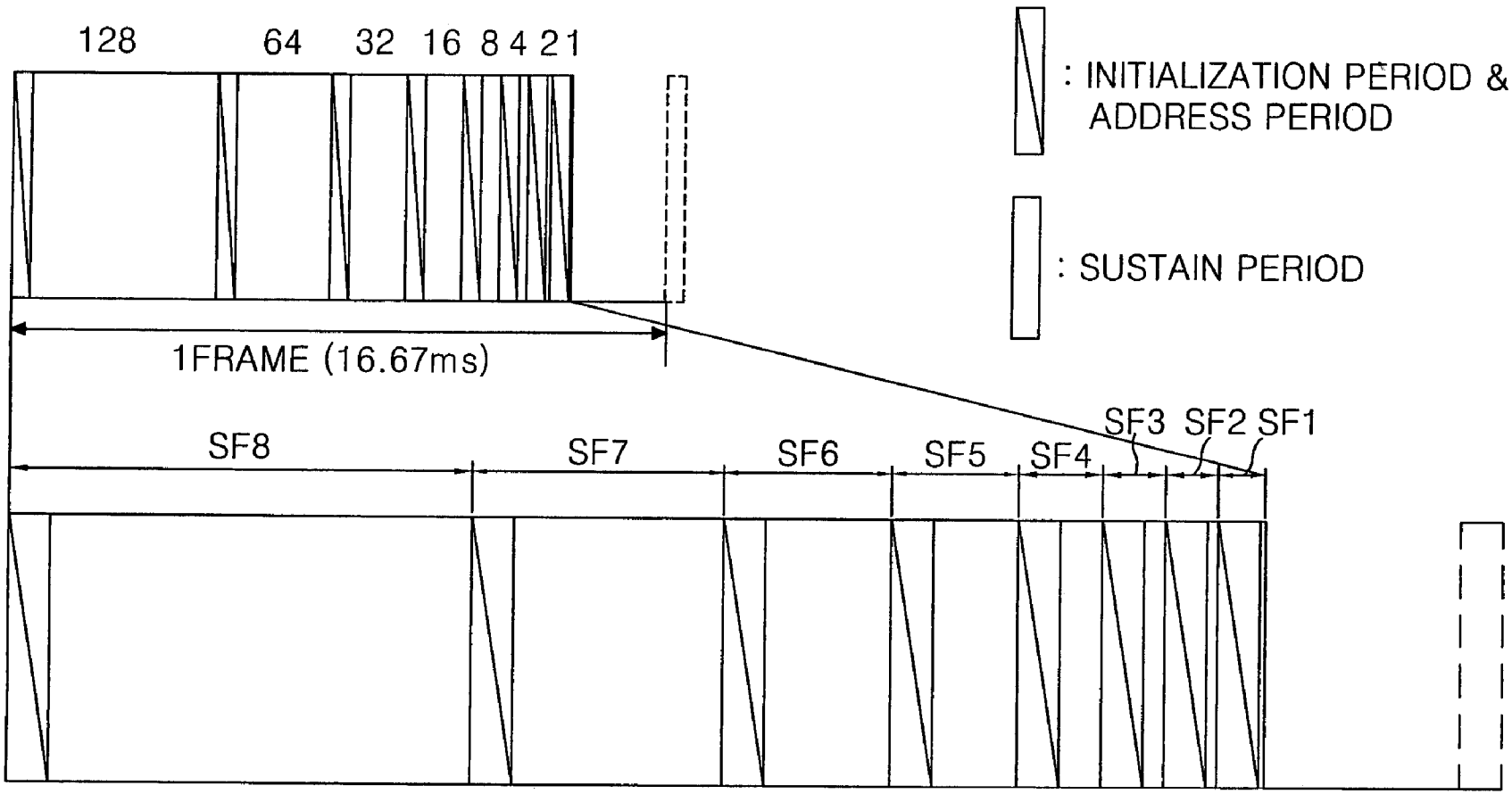
FIG.2 RELATED ART
FIG. 2 illustrates one frame in the conventional plasma display panel.
Figure 3:
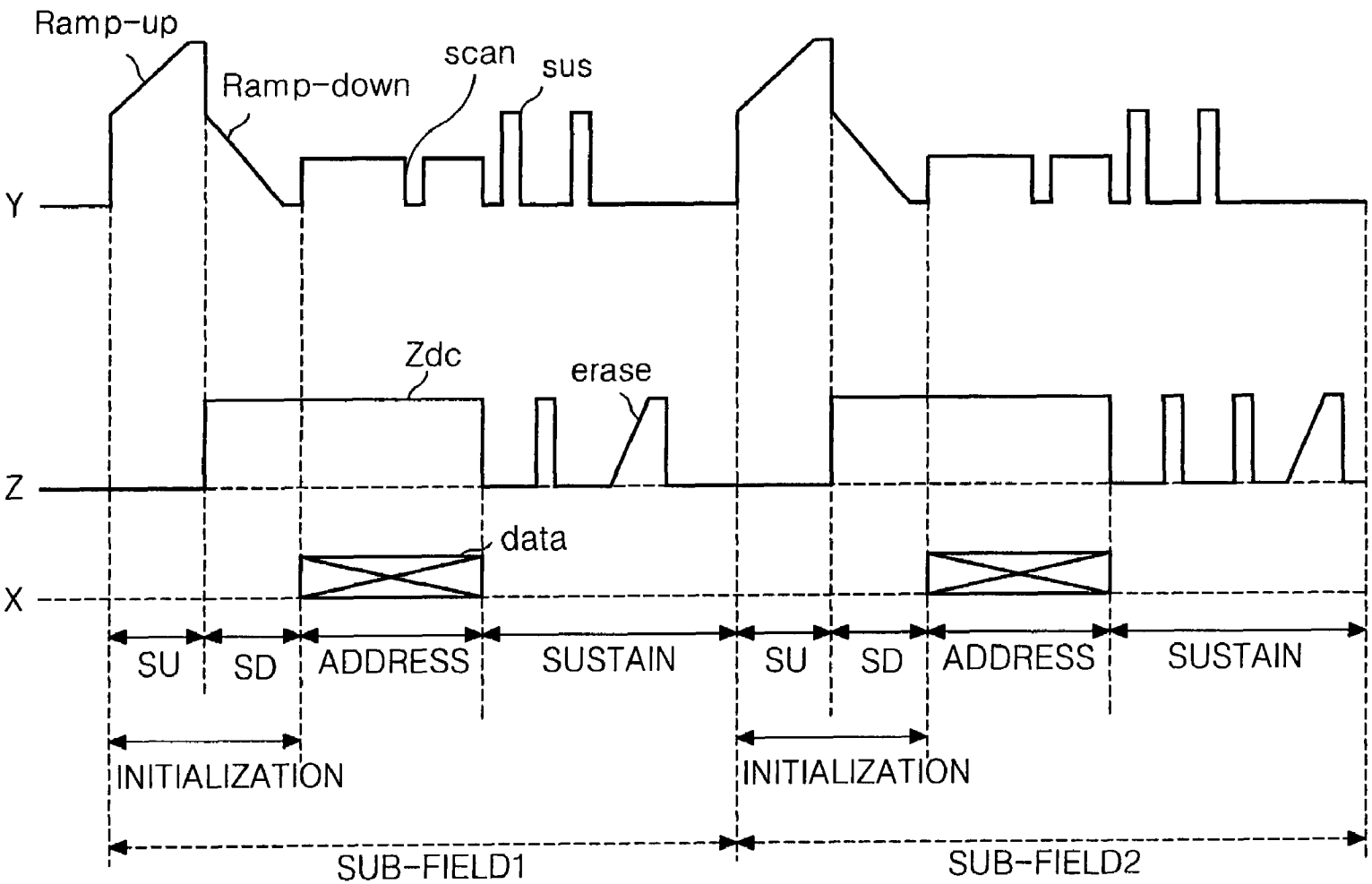
FIG. 3 RELATED ART
FIG. 3 is a waveform diagram of a driving signal applied in the sub-field period of the conventional plasma display panel.
Figure 4:
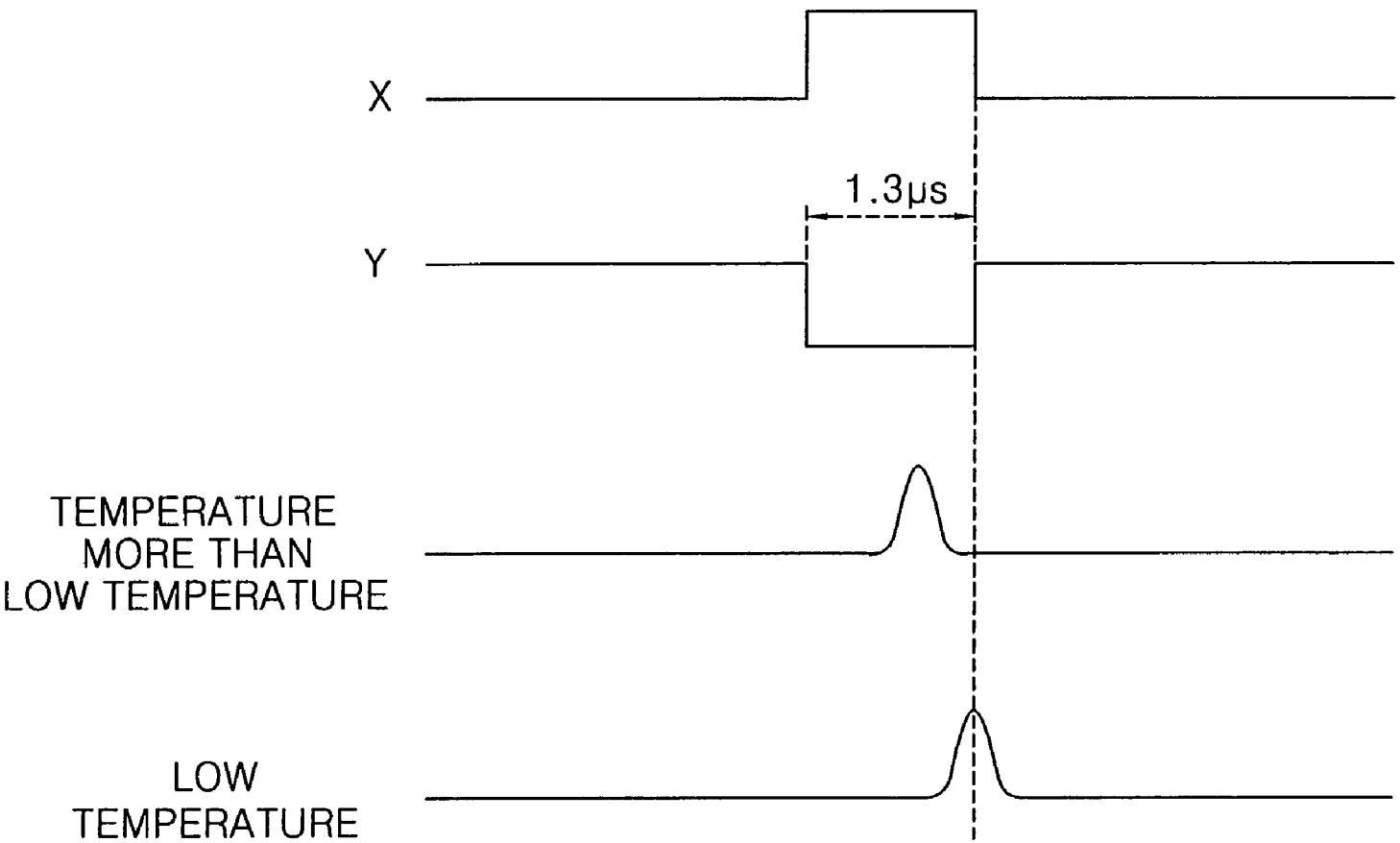
FIG. 4 RELATED ART
FIG. 4 depicts a discharge delay phenomenon occurring at the low temperature.
Figure 5:
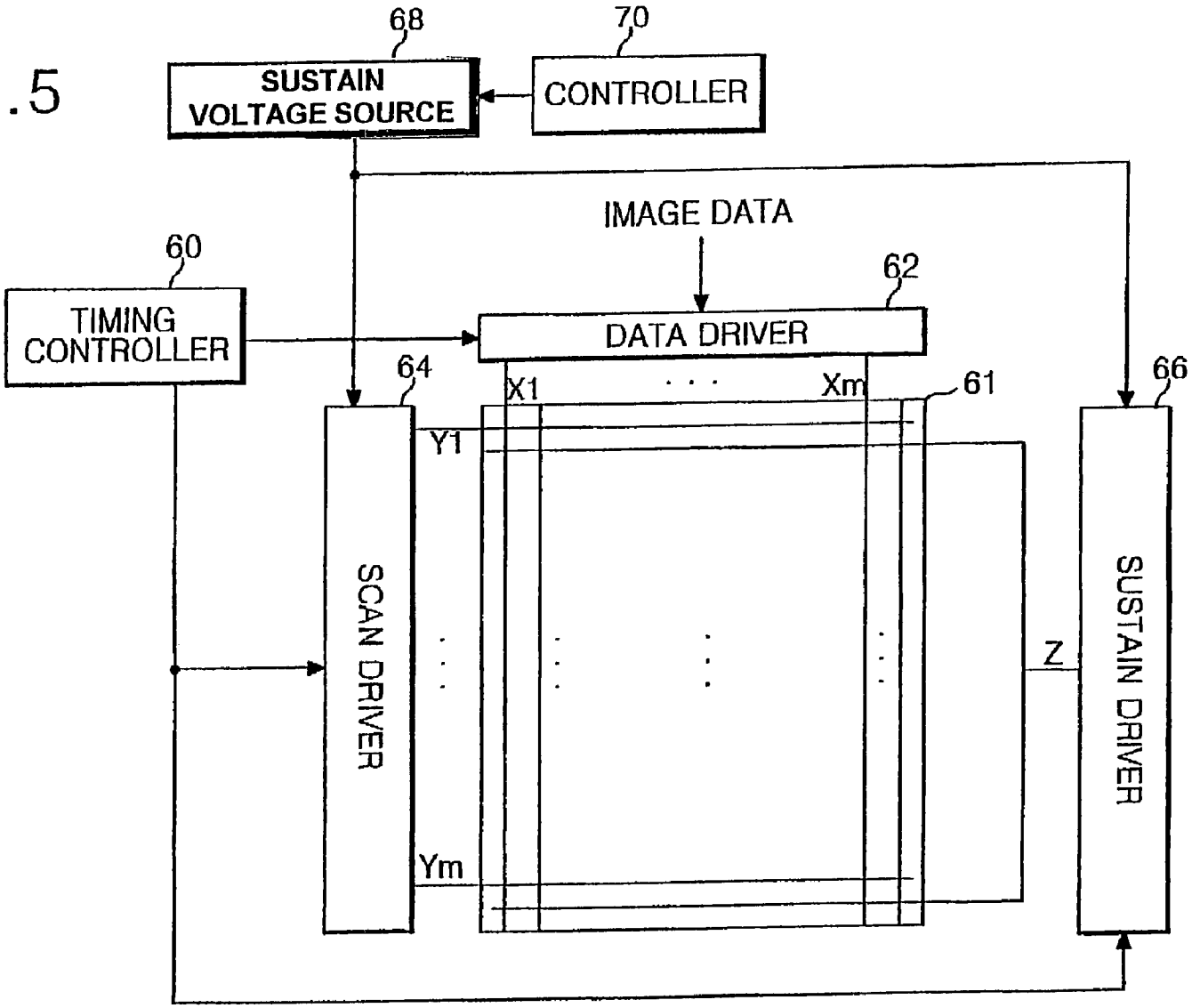
FIG. 5 is a block diagram showing a configuration of a driving apparatus for a plasma display panel according to a first embodiment of the present invention.

FIG. 5 shows a driving apparatus for a plasma display panel (PDP) according to a first embodiment of the present invention.

Referring to FIG. 5, the driving apparatus includes a data driver 62 for applying a data pulse to address electrodes X1 to Xm, a scan driver 64 for applying a scanning pulse and a sustaining pulse to scan electrodes Y1 to Ym, a sustain driver 66 for applying a sustaining pulse to a common sustain electrode Z, a timing controller 60 for controlling each driver 62, 64 and 66, a sustain voltage source for supplying a different sustain voltage in accordance with a driving temperature of a panel 61, and a controller 70 for measuring a driving temperature of the panel 61 and thus controlling the sustain voltage source 68.

The data driver 62 applies a data pulse corresponding to an image data supplied thereto to the address electrodes X1 to Xm.

The scan driver 64 supplies a rising ramp waveform and a falling ramp waveform to the scan electrodes Y1 to Ym in the initialization period and then sequentially applies a scanning pulse to the scan electrodes Y1 to Ym in the address period. Further, the scan driver 64 applies a sustaining pulse to the scan electrodes Y1 to Ym such that a sustaining discharge can be generated at the cell selected in the address period during the sustain period. Such a scan driver 64 generates a sustaining pulse with the aid of a driving voltage supplied from the sustain voltage source 68. Thus, a voltage level of the sustaining pulse generated from the scan driver 64 is set to be identical to that of a driving voltage supplied from the sustain voltage source 68.

The sustain driver 66 supplies a DC voltage to the common sustain electrode Z in the set-down interval and the address period. Further, the sustain driver 66 applies the sustaining pulse to the common sustain electrode Z during the sustain period such that a sustain discharge can cause at the cells selected in the address period. Such a sustain driver 66 generates a sustaining pulse with the aid of a driving voltage supplied from the sustain voltage source 68. Accordingly, a voltage level of the sustaining pulse generated from the scan driver 64 is set to be identical to that of a driving voltage supplied from the sustain voltage source 68.

The timing controller 60 receives vertical and horizontal synchronizing signals to generate timing control signals required for each driver 62, 64 and 66, and applies the timing control signals to each driver 62, 64 and 66.

The controller 70 senses a driving temperature of the panel to control the sustain voltage source 68. The sustain voltage source 68 supplies any one of various sustain voltages to the scan driver 64 and the sustain driver 66 under control of the controller 70.

Figure 6:
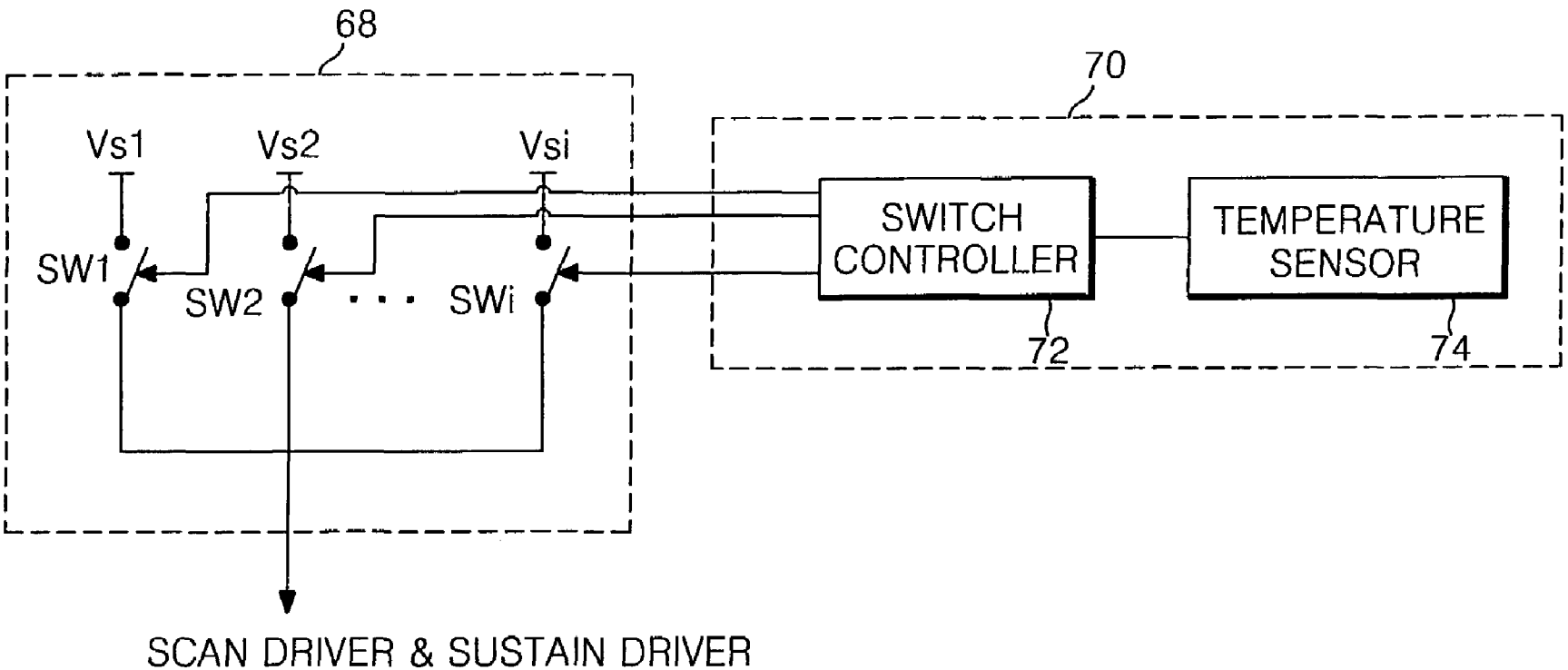
FIG. 6 is a detailed block circuit diagram of the controller and the sustain voltage source shown in FIG. 5.

To this end, as shown in FIG. 6, the controller 70 includes a temperature sensor 74 and a switch controller 72, and the sustain voltage source 68 includes a plurality of sustain voltage sources Vs1, Vs2, . . . , Vsi (wherein 1 is an integer) and a plurality of switching devices SW1, SW2, . . . , Swi.

Figure 7:
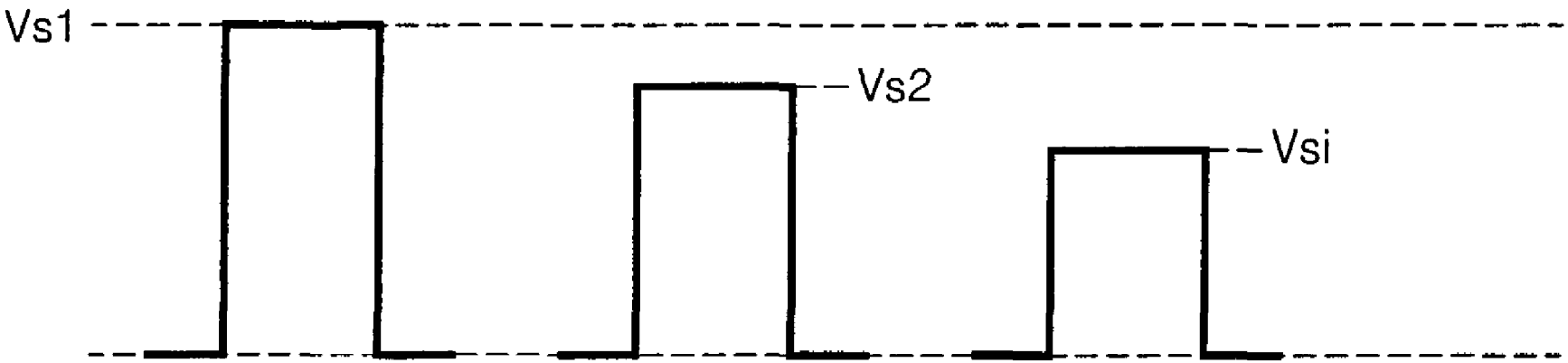
FIG. 7 illustrates voltage levels of the sustain voltage sources shown in FIG. 6.

Voltage values of the sustain voltage sources Vs1, Vs2, . . . , Vsi included in the sustain voltage source 68 are set differently from each other as shown in FIG. 7. For instance, a voltage value of the first sustain voltage sources Vs1 is set to be equal to that of the conventional sustain voltage source (i.e., 170V). Further, a voltage value (i.e., 167V) of the second sustain voltage sources Vs2 is set to be lower than that of the first sustain voltage source Vs1, and a voltage value (i.e., 150V) of the ith sustain voltage source is set to be lower than that of the second sustain voltage source Vs2. In other words, the sustain voltage source 68 according to the embodiment of the present invention includes a plurality of sustain voltage sources Vs1, Vs2, . . . , Vs1 whose voltage value is set to be gradually lowered from the conventional sustain voltage value.

The switching devices SW1, SW2, . . . , Vsi are provided among the sustain voltage sources Vs1, Vs2, . . . , Vsi, the scan driver 64 and the sustain driver 66 to be turned on or turned off under control of the switch controller 72.

The temperature sensor 74 senses a peripheral temperature at which the panel 61 is driven, to thereby apply a desired bit control signal to the switch controller 72. For instance, the temperature sensor 74 can apply a 4-bit control signal to the switch controller 72. Such a temperature sensor 74 applies a signal "0000" when a peripheral temperature at which the panel 61 is driven is approximately less than 40° C.

The switch controller 72 having received a bit control signal "0000" from the temperature sensor 74 turns on the first switch SW1. If the first switch SW1 is turned on, then the first sustain voltage Vs1 is applied to the scan driver 64 and the sustain driver 66. In other words, when a peripheral temperature at which the panel 61 is driven is approximately less than 40° C., the PDP is driven with the same voltage as the prior art. That is to say, when a peripheral temperature at which the panel 61 is driven is not a high temperature, a voltage level of the sustain pulse keeps at the same value as the prior art.

On the other hand, when a peripheral temperature at which the panel 61 is driven is about 42° C., a bit control signal "0001" is applied to the switch controller 72. The switch controller 72 having received a bit control signal "0001" from the temperature sensor 74 turns on the second switch SW2. If the second switch SW2 is turned on, then the second sustain voltage Vs2 having a lower voltage value than the first sustain voltage Vs1 is applied to the scan driver 64 and the sustain driver 66. In other words, when a peripheral temperature at which the panel 61 is driven, a voltage level of the sustain pulse is lowered.

Such a lowering of the sustain pulse upon driving of the panel 61 at the high temperature can prevent a driving temperature of the panel from rising more highly than the peripheral temperature, and thus can reduce a high-temperature mis-firing.

Meanwhile, when the peripheral temperature at which the panel is driven is about 80° C., the temperature sensor 74 applies a bit control signal "1111" to the switch controller 72. The switch controller 72 having received a bit control signal "1111" from the temperature sensor 74 turns on the ith switch Swi. If the ith switch Swi is turned on, then the ith sustain voltage Vs1 having a lower voltage value than the second sustain voltage Vs2 is applied to the scan driver 64 and the sustain driver 66.

Accordingly, the first embodiment of the present invention sets a voltage of the sustain pulse applied to the panel 61 upon high-temperature driving to be lower than a voltage level of the sustain pulse applied upon normal-temperature driving, thereby preventing a driving temperature of the panel 61 from rising more highly than the peripheral temperature and thus reducing a high-temperature mis-firing. Furthermore, the first embodiment divides the high temperature into a plurality of levels to thereby apply a sustain pulse having a lower voltage level as the level is more raised.

Figure 8:
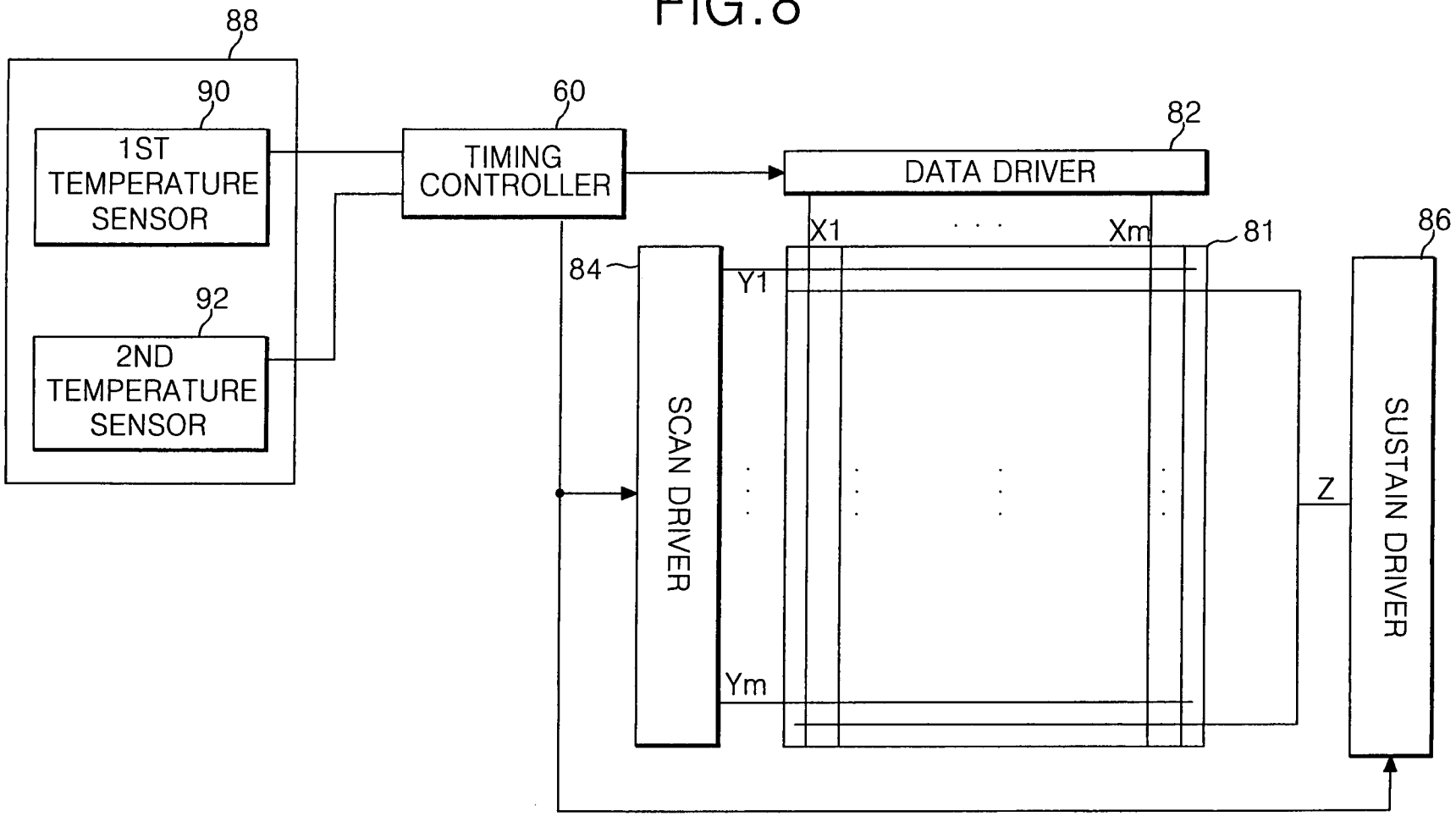
FIG. 8 is a block diagram showing a configuration of a driving apparatus for a plasma display panel according to a second embodiment of the present invention.

FIG. 8 shows a driving apparatus for a plasma display panel (PDP) according to a second embodiment of the present invention.

Referring to FIG. 8, the driving apparatus includes a data driver 82 for driving address electrodes X1 to Xm, a scan driver 84 for driving scan electrodes Y1 to Ym, a sustain driver 86 for driving a common sustain electrode Z, a timing controller 80 for controlling each driver 82, 84 and 86, and a temperature sensor 88 for sensing a driving temperature of a panel 81.

The data driver 82 applies a data pulse corresponding to an image data supplied thereto to the address electrodes X1 to Xm.

The scan driver 84 supplies a rising ramp waveform and a falling ramp waveform to the scan electrodes Y1 to Ym in the initialization period and then sequentially applies a scanning pulse to the scan electrodes Y1 to Ym in the address period. Further, the scan driver 84 applies a sustaining pulse to the scan electrodes Y1 to Ym such that a sustaining discharge can be generated at the cell selected in the address period during the sustain period. Such a scan driver 84 changes a sustaining pulse width and a scanning pulse width in correspondence with a driving temperature under control of the timing controller 80.

The sustain driver 86 supplies a DC voltage to the common sustain electrode Z in the set-down interval and the address period. Further, the sustain driver 66 applies the sustaining pulse to the common sustain electrode Z during the sustain period such that a sustain discharge can cause at the cells selected in the address period. Herein, the sustain driver 86 changes a sustaining pulse width in correspondence with a driving temperature under control of the timing controller 80.

The temperature sensor 88 senses a driving temperature of the panel 81 to apply a desired bit control signal to the timing controller 80. Such a temperature sensor 88 includes a first temperature sensor 90 for sensing a temperature at the high-temperature atmosphere, and a second temperature sensor 92 for sensing a temperature at the low-temperature atmosphere.

The timing controller 80 receives vertical and horizontal synchronizing signals to generate timing control signals required for each driver 82, 84 and 86, and applies the timing control signals to each driver 82, 84 and 86. Further, the timing controller 80 controls a sustain pulse width in correspondence with a bit control signal applied from the first temperature sensor 90. Also, the timing controller 80 controls a sustaining pulse width in correspondence with a bit control signal applied from the second temperature sensor 92.

Firstly, an operation procedure at the high-temperature atmosphere will be described in detail below.

Figure 9A:
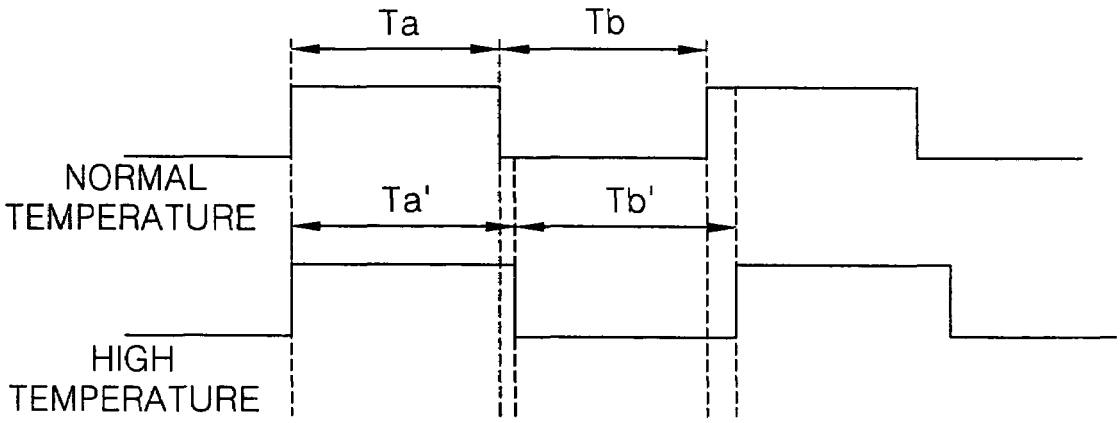
FIG. 9A to FIG. 9C are waveform diagrams of sustain pulses applied to the scan driver and the sustain driver shown in FIG. 8.

The first temperature sensor 90 applies a corresponding bit control signal (i.e., "0000") to the timing controller 80 when the panel 81 is driven at the normal temperature (i.e., less than 40° C.). The timing controller 80 having received a bit control signal corresponding to the normal temperature from the first temperature sensor 90 controls the scan driver 84 and the sustain driver 86 such that a sustain pulse having the same pulse width Ta (i.e., a high interval) and the same pulse gap Tb (i.e., a low interval) as the prior art, as shown in FIG. 9A, can be applied.

On the other hand, when the panel is driven at the high-temperature atmosphere, the first temperature sensor 90 generates a corresponding bit control signal and applies it to the timing controller 80. The timing controller 80 having received a bit control signal corresponding to the high-temperature atmosphere from the first temperature sensor 90 controls the scan driver 84 and the sustain driver 86 such that a sustain pulse having a wider period than a sustain pulse applied at the normal temperature as shown in FIG. 9A can be applied. In this case, the timing controller 80 controls the scan driver 84 and the sustain driver 86 such that both the width Ta' and the gap Tb' of the sustaining pulse can be set to be wider than those of the sustaining pulse at the normal temperature.

If a period of the sustaining pulse is set widely as described above, then a driving margin of the sustain voltage is improved. In other words, if a period of the sustaining pulse is set widely, then a time capable of causing the sustain discharge is lengthened to thereby improve a driving margin of the sustain voltage. For instance, the second embodiment of the present invention sets a period of the sustaining pulse widely when it is driven at the high temperature, thereby causing a stable sustain discharge at the high-temperature atmosphere.

Figure 9B:
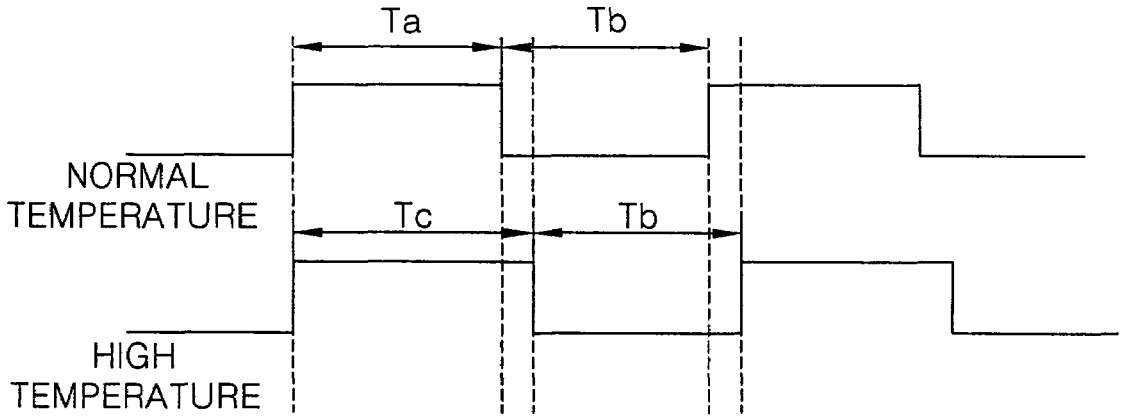
Figure 9C:
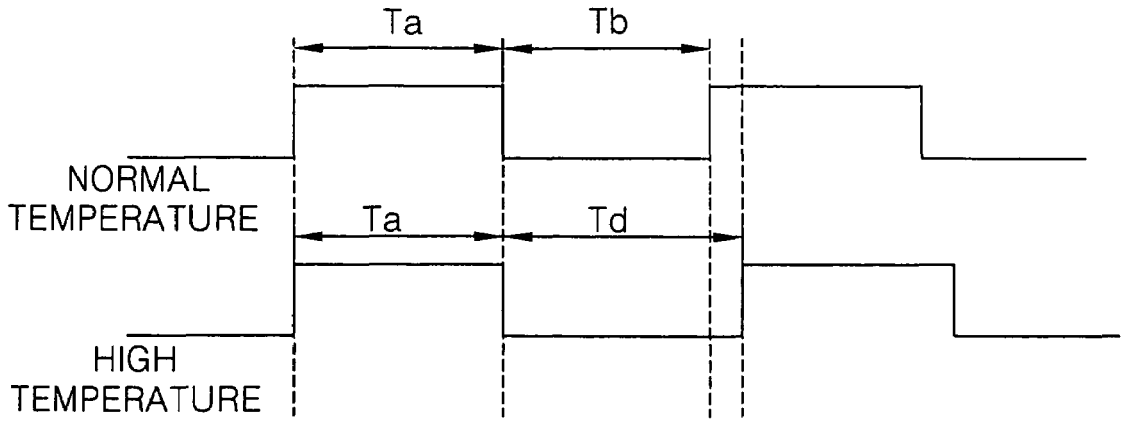

Alternatively, the second embodiment may enlarges only a width Tc of the sustaining pulse while keeping a gap Tb of the sustaining pulse equally from the prior art as shown in FIG. 9B. In real, if the Tc of the sustaining pulse is enlarged, then a sustain driving margin can be improved to thereby prevent a high-temperature mis-firing. Further, the second embodiment may enlarge only a gap Td of the sustaining pulse while keeping a width Ta of the sustaining pulse equally from the prior art as shown in FIG. 9C. In real, if the gap Td of the sustaining pulse is enlarged, then a sustain driving margin can be improved to thereby prevent a high-temperature mis-firing.

Figure 10:
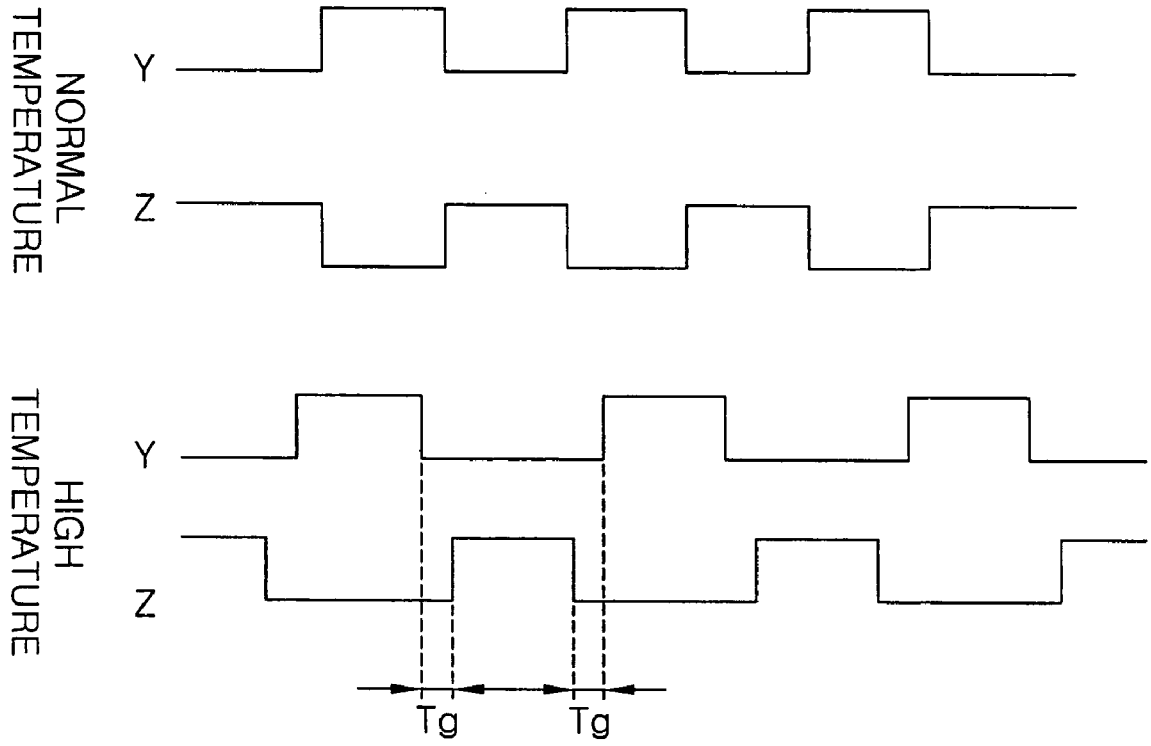
FIG. 10 is a waveform diagram of sustain pulses applied at the normal temperature and the high temperature.

The second embodiment of the present invention can set a ground gap Tg between the sustaining pulses widely independently of a width and a gap of the sustaining pulse as shown in FIG. 10. If the ground gap Tg between the sustaining pulses is set widely experimentally, then a driving margin of the sustain voltage is improved. In other words, the second embodiment sets a ground gap Tg between the sustaining pulses to thereby prevent a high-temperature mis-firing.

Meanwhile, the first temperature sensor 90 divides the temperature level into a plurality of levels, and applies a different bit control signal to the timing controller 80 for each level. At this time, the timing controller 80 controls the scan driver 84 and the sustaining driver 86 such that a sustaining pulse having a gradually wider period in correspondence with a higher temperature level can be applied. In other words, the second embodiment divides the high temperature into desired levels and applies a sustaining pulse having a wider period as the level is more raised, that is, as the temperature is more raised, thereby causing a stable sustain discharge at the high temperature.

Figure 11A:
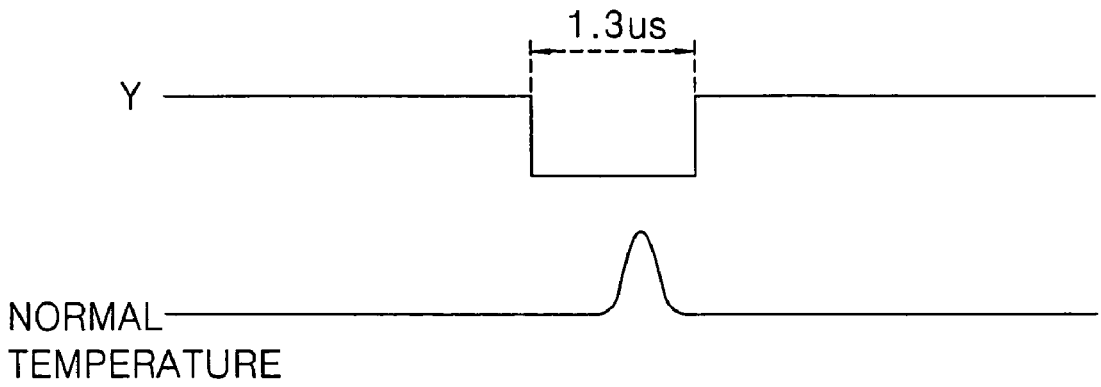
FIG. 11A to FIG. 11D are waveform diagrams of scanning pulses applied to the scan driver shown in FIG. 8.

The second temperature sensor 92 applies a corresponding bit control signal (i.e., "0000") to the timing controller 80 when the panel 81 is driven at the normal temperature (i.e., more than 20° C.). The timing controller 80 having received a bit control signal corresponding to the normal temperature from the second temperature sensor 92 controls the scan driver 84 and/or the data driver 82 such that a scanning pulse and/or a data pulse having the same width as the prior art can be generated. For instance, the timing controller 80 applies a scanning pulse for about 1.3 μs as shown in FIG. 11A when the panel 81 is driven at the normal temperature. Herein, a width of the scanning pulse is set variously on a basis of a resolution and a length (i.e., inch), etc. of the PDP. But, in the second embodiment, it is assumed that a scanning pulse having 1.3 μs should be applied at the normal temperature for the convenience of an explanation.

On the other hand, when the panel 81 is driven at the low-temperature atmosphere (i.e., 20° C. to −20° C.), the second temperature sensor 92 generates a corresponding bit control signal to apply it to the timing controller 80. Herein, the second temperature sensor 92 divides the low temperature into a plurality of temperature levels, and applies a different bit control signal to the timing controller 80 for each temperature level.

Figure 11B:
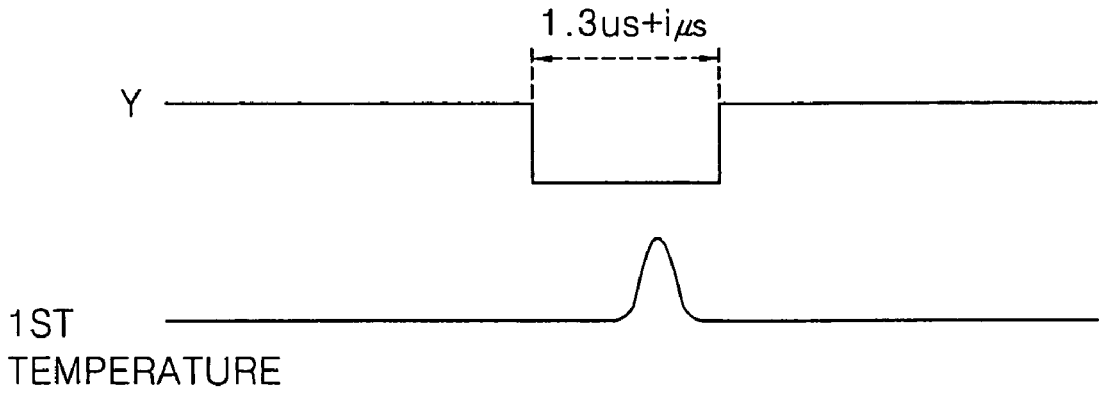

The timing controller 80 having received a bit control signal corresponding to the low temperature from the second temperature sensor 92 controls the scan driver 84 such that a scanning pulse having a larger pulse width (i.e., 1.3 μs+i μs, wherein i is an integer) than the low temperature as shown in FIG. 11B can be applied. Further, the timing controller 80 controls the data driver 82 such that a data pulse having a pulse width (i.e., 1.3 μs+i μs) corresponding to the scanning pulse can be applied. If the scanning pulse and the data pulse having a large pulse width at the low temperature is applied as described above, then it is possible to cause a stable address discharge independently of a discharge delay phenomenon occurring at the low temperature.

Figure 11C:
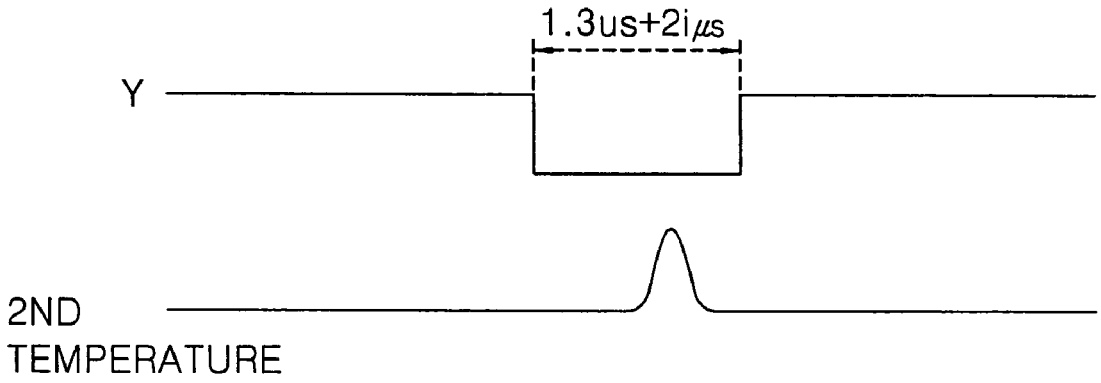
Figure 11D:
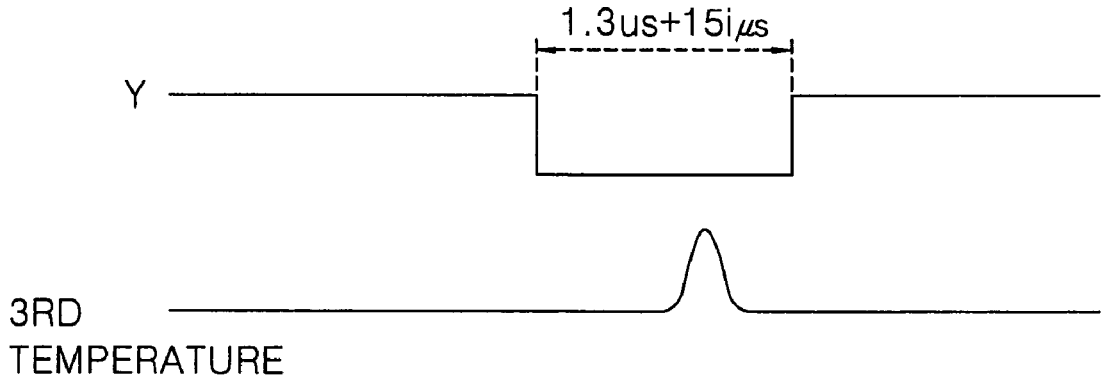

Meanwhile, if a bit control signal having a low temperature level is applied from the second temperature sensor 92, then the timing controller 80 controls the scan driver 84 such that it can correspond to the temperature, that is, such that a scanning pulse having a larger width as shown in FIG. 11C and FIG. 11D as the temperature is more lowered can be applied. Further, the timing controller 80 sets widths of the scanning pulse and the data pulse in consideration of total time for an addressing and a pulse width capable of causing a stable address discharge, etc. For instance, the timing controller 80 can set widths of the scanning pulse and the data pulse to be approximately 0.5 μs to 5 μs.

In the mean time, a combination of the first embodiment and the second embodiment are applicable to the present invention. In other words, a period of the sustaining pulse at the high temperature is set widely and, at the same time, a voltage value of the sustaining pulse is lowered, thereby preventing a high-temperature misfiring. Furthermore, widths of the scanning pulse and the data pulse at the low temperature are set widely, thereby preventing a low-temperature mis-firing.

As described above, according to the present invention, a voltage value of the sustaining pulse at the high-temperature atmosphere is set lowly or a period of the sustaining pulse is set largely, thereby preventing a high-temperature mis-firing. Furthermore, according to the present invention, a width of the scanning pulse at the low temperature is set largely, thereby preventing a low-temperature mis-firing.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a plasma display panel, comprising:

a scan driver configured to provide a first scan signal and a first sustaining pulse to a scan electrode during an addressing period and a sustain period, respectively, wherein the first signal transits from a first potential to a second potential and after a first prescribed period of time, transits from the second potential to the first potential;

a sustain driver configured to provide a second sustaining pulse alternating with the first sustaining pulse to a common sustain electrode during the sustain period, wherein the second sustaining pulse has a second prescribed period of a high state and a low state;

a sustain voltage source configured to provide a driving voltage to the scan driver and the sustain driver; and a controller to control the scan driver and the sustain driver such that the first prescribed period and the second prescribed period are variable based on a temperature of the panel.

2. The driving apparatus of claim 1, wherein the first prescribed period increases as temperature decreases from a normal temperature of the panel.

3. The driving apparatus of claim 1, wherein the second prescribed period increases as temperature increases from a normal temperature of the panel.

4. The driving apparatus of claim 1, wherein the controller further controls the sustain voltage source such that the high state of the second sustain pulse has different voltage values based on the temperature of the panel.

5. The driving apparatus of claim 4, wherein the voltage values decreases as temperature of the panel increases from a normal temperature.

6. The driving apparatus of claim 3, further comprising at least one sensor to detect the temperature.

7. The driving apparatus of claim 3, wherein the normal temperature is any temperature greater than about 20 degree Celsius and less than about 40 degree Celsius.

8. The driving apparatus of claim 4, wherein the temperature corresponds to peripheral temperature of the panel.

* * * * *